US006793157B1

(12) United States Patent
Lindsay et al.

(10) Patent No.: US 6,793,157 B1
(45) Date of Patent: Sep. 21, 2004

(54) METHOD AND APPARATUS FOR SPRAYING

(75) Inventors: James Lindsay, Saltcoats (GB); George Walter Robinson, Spalding (GB)

(73) Assignee: Jim Lindsay Limited, Irvine (GB)

( * ) Notice: Subject to any disclaimer, the term of this patent is extended or adjusted under 35 U.S.C. 154(b) by 0 days.

(21) Appl. No.: 09/830,209

(22) PCT Filed: Oct. 20, 1999

(86) PCT No.: PCT/GB99/03476

§ 371 (c)(1),
(2), (4) Date: Aug. 7, 2001

(87) PCT Pub. No.: WO00/24521

PCT Pub. Date: May 4, 2000

(30) Foreign Application Priority Data

Oct. 22, 1998 (GB) ..... 9823032

(51) Int. Cl.[7] ..... B05B 7/02; B05B 1/30; B05B 7/10

(52) U.S. Cl. ..... 239/527; 239/569; 239/579; 239/406; 239/418

(58) Field of Search ..... 239/527, 569, 239/579, 398, 399, 403, 405, 406, 407, 413, 417.3, 417.5, 418, 419.5, 290, 300

(56) References Cited

U.S. PATENT DOCUMENTS

| | | | | |
|---|---|---|---|---|
| 3,796,376 A | | 3/1974 | Farnsteiner | |
| 3,970,221 A | | 7/1976 | Fleischer | |
| 4,185,778 A | | 1/1980 | Drlik | |
| 4,232,832 A | | 11/1980 | De Fusco | |
| 4,245,784 A | * | 1/1981 | Garcin | 239/3 |
| 5,452,856 A | * | 9/1995 | Pritchard | 239/297 |
| 5,478,595 A | * | 12/1995 | Matou | 427/127 |
| 6,148,536 A | * | 11/2000 | Iijima | 34/92 |

FOREIGN PATENT DOCUMENTS

| | | |
|---|---|---|
| EP | 0 389 657 | 10/1990 |
| EP | 0 634 224 | 1/1995 |
| WO | WO 94/13404 | 6/1994 |

* cited by examiner

*Primary Examiner*—Davis Hwu
(74) *Attorney, Agent, or Firm*—Drinker Biddle & Reath LLP

(57) ABSTRACT

A low volume-low pressure spray gun (10) for spraying a fluid has a housing (12), a gas input (16), a trigger valve mechanism, and a nozzle (14). The gun (10) has lower and upper air passages (38, 39) which connect the gas input (16) to the trigger valve mechanism (23), and the trigger valve mechanism to the nozzle (14), respectively. The upper passage (39) is offset from the lower passage (38) and is substantially conical in shape, the layout of the passages (38, 39) producing a gas vortex in the upper passage (39) which creates a gas acceleration to compensate for the low pressure of the gas entering the gas input (16). The trigger valve mechanism comprises a piston valve (23), a liquid control needle valve (22), and a trigger (40). The piston valve (23) may include inner and outer apertured sleeves (**26*a*, 26*b*), the sleeves being co-axial with the inner sleeve (26*a*) located inside the outer sleeve (26*b*). The inner sleeve (26*a*) is rotatably adjustable relative to the outer sleeve (26*b*) so that the apertures (61, 62) of the sleeves (26*a*, 26*b***) may be aligned, partially aligned, or closed, thus permitting adjustment of the gas vortex.

28 Claims, 8 Drawing Sheets

Section VI - VI

METHOD AND APPARATUS FOR SPRAYING

The present invention relates to a method and apparatus for low air pressure spraying. Particularly, but not exclusively, the invention is applicable to spray guns for the application of paint and like material surface treatments, particularly water-based paints.

The use of spray guns for application of paints is well known. However, it has been found that when water-based, high gloss paints are sprayed through a high pressure or conventional spray gun, the level of gloss is reduced. This is also true of the high volume-low pressure type of spray gun which operate at only 10 psi air cap pressure.

Tests carried out at various pressures have shown that the loss of gloss is due to air bubbles rising to the surface of the paint as it dries. It has been found that the greater the pressure used to spray the paint, the more air bubbles appear. The cause of the bubbles is that dissolved air is being released from the water as the paint dries. The greater the air pressure when the paint is sprayed, the greater the volume of dissolved air and the greater the number of bubbles.

If the air pressure is low but the volume is high, gloss levels are reduced. To achieve the desired gloss levels with this type of paint it is necessary to design a spray gun that will operate at very low air pressures and very low air volumes. It must achieve acceptable levels of atomization, have sufficient energy to transfer the paint at an acceptable rate to the surface of the target, and expand the natural cone of spray into a useful fan pattern.

In the past, spray guns have used air pressures between 40 and 90 psi, and these high pressures cause a cushion of air to be formed on the surface of the product being treated. This cushion causes some of the sprayed material to bounce back and be displaced laterally by the following airflow to be lost in the surrounding air.

Accordingly, this type of spray gun is very inefficient. Rarely are transfer efficiencies greater than 40% and more often nearer 30%. The waste paint material produces unacceptable emissions of volatile organic compounds and leaves a solid residue which can remain floating in the air for some time. These can be highly toxic and damaging to the atmosphere and health. To overcome these problems, it is necessary to reduce the air pressure and air volume used in such guns. Therefore, the environmental requirements for an acceptable spray gun are similar to those required for achieving a good gloss in water-based paints.

If the air pressure is reduced on a spray gun that was originally designed for high pressure use, the turbulence and restrictions in internal air passages and the air cap cause a loss of air speed and a reduction in air volume. The result of this is low paint transfer rates, poor atomization and an inferior paint finish. However, transfer efficiency is improved. If the air volume is increased while keeping the pressure low, the ratio of air to paint increases and the problems experienced with high pressure will return depending on the increase in volume.

Existing high pressure spray guns have been modified to operate at low pressures, but the complexity of the designs and the intricate interconnecting drilled passages do not permit good air flow. In an effort to overcome the poor performance, air cap ring gaps were increased, resulting in a substantial increase in air consumption. This type of spray gun has become known as the high volume-low pressure (HVLP) gun.

More specifically, in HVLP spray guns the means for actuating the control valves within the gun have had considerable shortcomings. For example, it is commonplace for the stem of the needle valve and its associated compression spring and housing to extend through the main air flow passage to the nozzle, thereby leading to significant restrictions in the air flow path.

Likewise, in order to provide a convenient means for actuating the stem of the air flow and fluid needle valves, the main nozzle of the apparatus is mounted on a forward projection of the apparatus so as to leave a free space to accommodate the arc of movement of the valve control trigger.

Moreover, since the same trigger operates both the liquid and air control valves, the progressive control from on to off operating characteristics of the air control valve can be restricted in certain operating conditions where the liquid control valve has been manually adjusted to such a point that it affects the ability of the trigger to operate both valves simultaneously through the full range of movement.

The object of the present invention is to provide a method and apparatus for spraying paint and other surface treatment liquids, offering improvements in relation to one or more of the matters discussed above, or generally.

According to a first aspect of the invention there is provided an apparatus for spraying liquid surface treatment material, said apparatus having a housing, a liquid inlet for supply of the liquid surface treatment material, a gas inlet for supply of pressurised gas to be mixed with the liquid surface treatment material, an outlet nozzle through which the gas and liquid surface treatment material is sprayed, a control valve adapted to regulate the supply of the liquid surface treatment material to the outlet nozzle, a gas valve operable between an open position and a closed position, a first communicating passageway connecting said gas inlet to said gas valve, and a second communicating passageway connecting said gas valve to said outlet nozzle; wherein said second passageway is provided with a stepped portion therein so that a gas vortex is created therethrough.

Preferably, said second passageway is offset from said first passageway. Preferably, said second passageway is substantially conical in shape. Preferably, said second passageway includes an inlet and an outlet, wherein said passageway is tapered from said inlet to said outlet. Preferably, said taper is between 1 and 15°.

Preferably, said stepped portion of said second passageway comprises a ledge whose width tapers up to a maximum of 10% of the radius of said second passageway at the level of the stepped portion.

Preferably, said second passageway has a radius of curvature at said outlet so as to provide gas to the nozzle in a substantially horizontal direction.

Preferably, the longitudinal axis of said outlet nozzle extends across said second passageway. Preferably, the axis of symmetry of said ledge is offset from said longitudinal axis of said outlet nozzle, thereby inducing a vortex in the air flowing through said passageway.

According to a second aspect of the invention there is provided an apparatus for spraying liquid surface treatment material, said apparatus having a housing, a liquid inlet for supply of the liquid surface treatment material, a gas inlet for supply of pressurised gas to be mixed with the liquid surface treatment material, an outlet nozzle through which the gas and liquid surface treatment material is sprayed, a control valve adapted to regulate the supply of the liquid surface treatment material to the outlet nozzle, a gas valve operable between an open position and a closed position, a first communicating passageway connecting said gas inlet to said gas valve, and a second communicating passageway connecting said gas valve to said outlet nozzle; wherein said second passageway is axially offset from said first passageway and is substantially conical in shape, and wherein said second passageway includes an inlet and an outlet and is tapered from said inlet to said outlet at an angle of taper of between 1 and 15°.

Preferably the apparatus further comprises a trigger means, whereby said trigger means is adapted to operate both of said control valve and said gas valve.

Preferably, said gas valve is an axially-sliding piston valve. Preferably, said control valve is a liquid control needle valve.

Preferably, said outlet nozzle is controlled by said liquid control needle valve.

Preferably, said piston valve produces an annular air jet in said second passageway. The piston valve may be tapered or parallel. In addition, an air control valve stem is provided which is connected to the piston valve and operated by said trigger means.

Preferably, said piston valve comprises inner and outer co-axial apertured sleeves, wherein said inner sleeve is located within said outer sleeve and is rotatably adjustable relative to said outer sleeve.

Preferably, the liquid control needle valve is controlled by said trigger means via an axially-sliding sleeve or slipper member situated on a rearward portion of the housing. Preferably, it is also provided with a rotational flow adjustment means to adjust the flow rate of the liquid.

Preferably, said flow adjustment means comprises a stem member, a rotational adjuster, and a return spring, said stem member being threaded at its rearmost extremity to accept the rotational adjuster. Preferably, said stem member is actuated externally by the trigger means, and is returned to its initial position by a return spring.

Preferably, the apparatus further comprises a regulating valve and a pair of side jets, whereby the spray pattern of the outlet nozzle is regulated by said regulating valve, and said side jets are utilised to regulate said spray pattern.

Preferably, the needle valve is supplied with the paint or material surface treatment liquid by a pressurized material supply connector which distributes the material via a radial port to said needle valve. Alternatively, the material may be introduced to the apparatus from a gravity liquid reservoir fitted to the uppermost aspect of the apparatus via a radial port.

According to a third aspect of the present invention, there is provided a method of spraying a fluid onto a surface, said method comprising the steps of:

supplying a liquid to be sprayed into a liquid inlet of a spray apparatus;

supplying a pressurised gaseous propellant into a gas inlet of said spray apparatus;

passing said gaseous propellant through a communicating passageway from said gas inlet to an outlet nozzle;

accelerating said gaseous propellant by creating a gas vortex as said propellant passes through said communicating passageway;

passing said accelerated propellant through an outwardly tapering portion of the communicating passageway to further accelerate the vortex and supply the propellant to the outlet nozzle in the form of an annular gas jet; and spraying said liquid onto a surface by mixing said liquid and said annular gas jet at said nozzle.

Preferably, said passageway comprises an upper portion and a lower portion, wherein said upper portion is axially offset from said lower portion and is substantially conical in shape. Preferably, said upper portion of said passageway includes an inlet and an outlet and is tapered from said inlet to said outlet at an angle of taper of between 1 and 15°.

Preferably, the mixing of said liquid and said annular gas jet is controlled by a trigger valve mechanism on said spray apparatus. Preferably, said trigger valve mechanism comprises:

a gas valve operable between an open position and a closed position;

a control valve adapted to regulate the supply of the liquid to be sprayed; and a trigger means;

whereby said trigger means is adapted to operate both of said gas and control valves.

Preferably, said control valve is a liquid control needle valve. Preferably, said gas valve is an axially-sliding piston valve. Preferably said piston valve comprises an inner apertured sleeve and an outer apertured sleeve, said inner and outer sleeves being co-axial, and wherein said inner sleeve is located within said outer sleeve and is rotatably adjustable relative to said outer sleeve.

Embodiments of the invention will now be described by way of example with reference to the accompanying drawings in which:

FIG. 4(*b*) is a sectional view along line "A—A" of FIG. 4(*a*);

FIG. 4(*c*) is a sectional view along line "B—B" of FIG. 4(*a*), showing the stepped portion of the upper air passage;

FIG. 6(*b*) shows the component parts of the piston valve of the spray gun of FIGS. 5 and 6(*a*); and FIG. 6(*c*) shows a sectional view along line "VI—VI" of FIG. 6(*a*).

Figure 1:
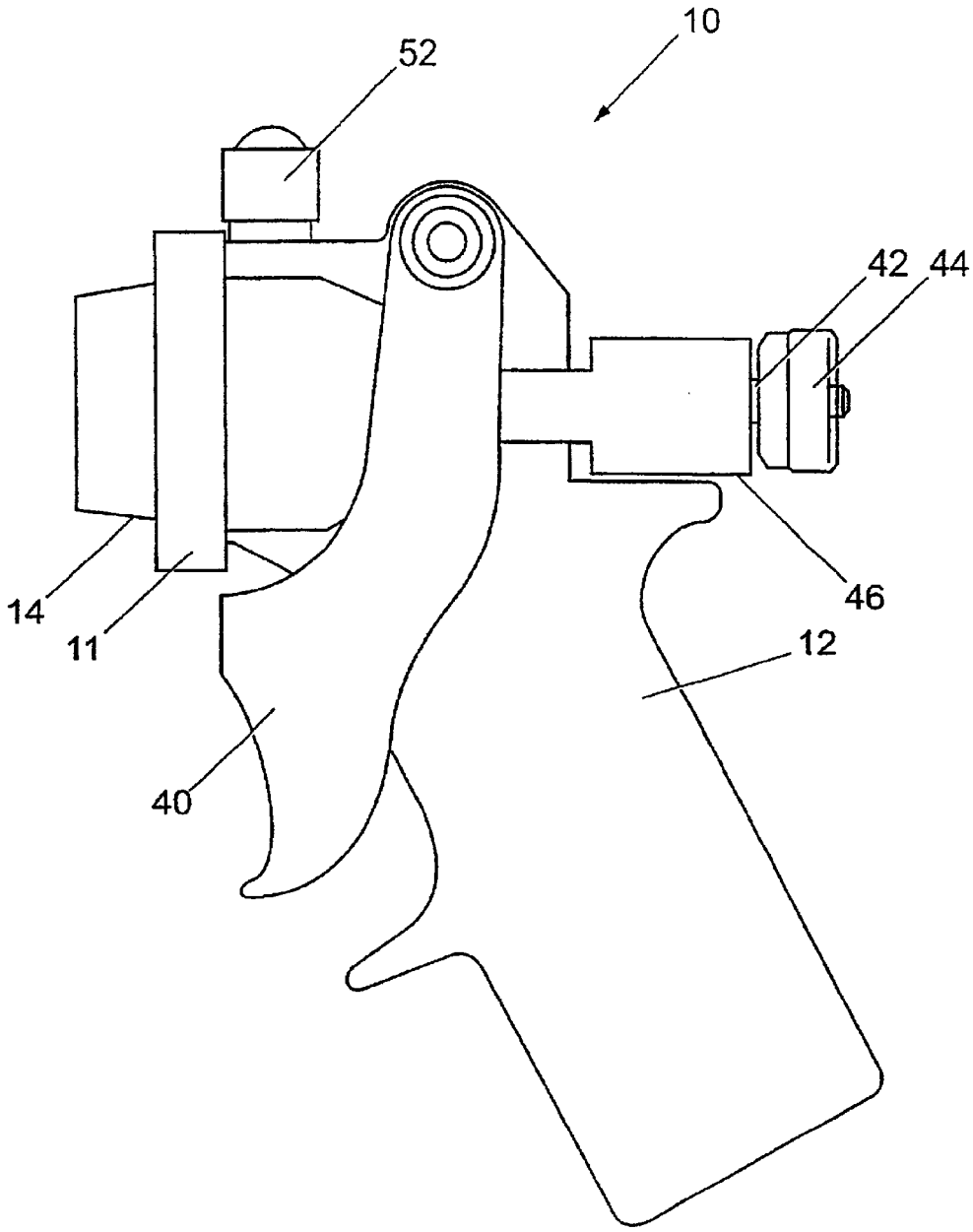
FIG. 1 shows a first embodiment of a spray gun according to the present invention.

As shown in FIG. 1, a first embodiment of a spray apparatus 10 comprises a body or housing 12 having a nozzle 14, an operating trigger 40, and a regulating valve 52. Nozzle 14 is secured to the housing 12 by a threaded ring 11.

Figure 2:
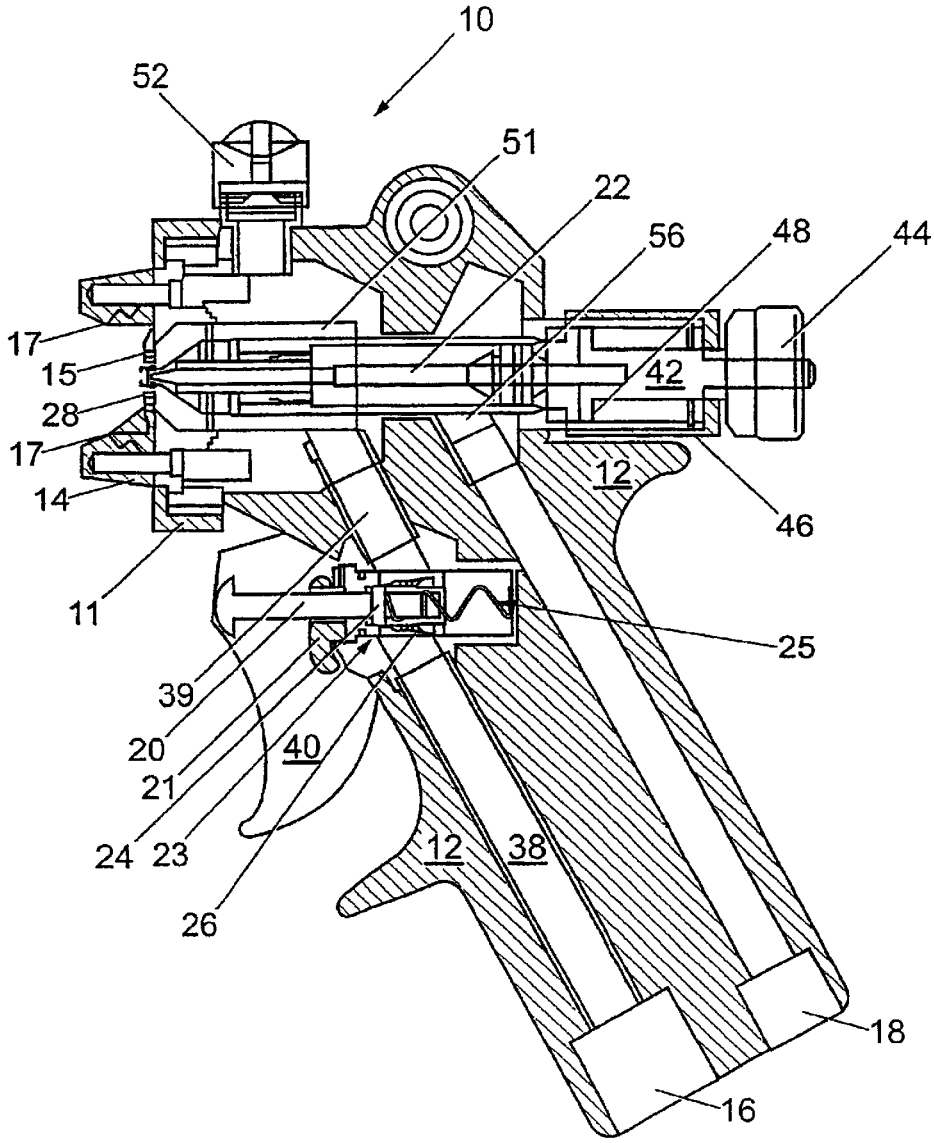
FIG. 2 shows a section through the spray gun of FIG. 1 having pressure feed and offset air passages.

FIG. 2 shows a section view through the spray gun which shows the components of the apparatus 10 in more detail. The apparatus 10 has an air supply connection 16, a pressurized material supply connection 18, an air control valve stem 20, and a liquid control valve 22. It will be noticed that in this embodiment, and each of the subsequent embodiments described herein, the air supply connection 16 and material supply connection 18 and their respective supply passages are located in the handle portion of the apparatus 10. By locating both supply connections 16, 18 in the handle portion, the apparatus 10 can be packaged in a more compact manner than prior art apparatus. Furthermore, by being located in the handle the supply passages are free from the internal restrictions which can hamper the performance of known apparatus.

A tapered piston valve 23 controls the supply of air to the nozzle 14 in order to regulate the spray pattern. The nozzle 14 provides a central jet 15 controlled by the liquid control needle valve 22, and an annular air jet 28 controlled by the piston valve 23. The air control valve stem 20 connects to an axially-sliding piston 24 to effect progressive throttling of the air flow. The stem 20 is pushed by an operating trigger 40.

The air supply connection 16 is coupled to a compressor (not shown) which provides air under pressure to the air supply connection 16. Connection 18 is supplied by a reservoir (not shown) containing paint or like material to be sprayed.

The liquid control needle valve 22 has a rotational adjuster 44 and is controlled by the trigger 40 through a sleeve member 46 which slides on a rearward portion 48 of the housing 12. The trigger 40 acts on the sleeve 46 by way of a flange (not shown) on the sleeve 46, thereby opening the needle valve 22 to allow liquid to pass through.

A regulating valve 52 is positioned whereby the jet 15 produced by nozzle 14 is regulated from a natural cone to a fan pattern by air from side jets 17.

The air passage 38 connects the air supply connection 16 with the piston valve 23. The air control valve stem 20 controls the air flow through a pair of offset passages 38 and 39, where the lower passage 38 and the upper passage 39 are offset to create a vortex within the upper passage 39, thereby accelerating the gas flow through said upper passage 39. A return spring 25 is also provided in order to return the piston 24 and stem 20 to their extended position when released. The piston valve 23 has two apertured rotational sleeves 26 which can be adjusted by a lever 21 to either line up, close off or partially close the apertures, thereby increasing or decreasing the vortex in the passage 39. Thus, the pressure in the gun can be regulated to offer variable pressure sprays. A more detailed description of the operation of the piston valve 23 is given later.

The liquid control valve needle 22 has a stem member 42 which passes through sleeve member 46 and is threaded at its rearmost extremity to accept the rotational adjuster 44. The rotational adjuster 44 allows fine position adjustment of the fluid control needle 22. Trigger 40 actuates the needle member 22 externally of the housing 12. An internal return spring (not shown) returns the needle 22 to its rest position. Liquid to be sprayed is fed to the needle valve 22 from connection 18 via a radial port 56.

Figure 3:
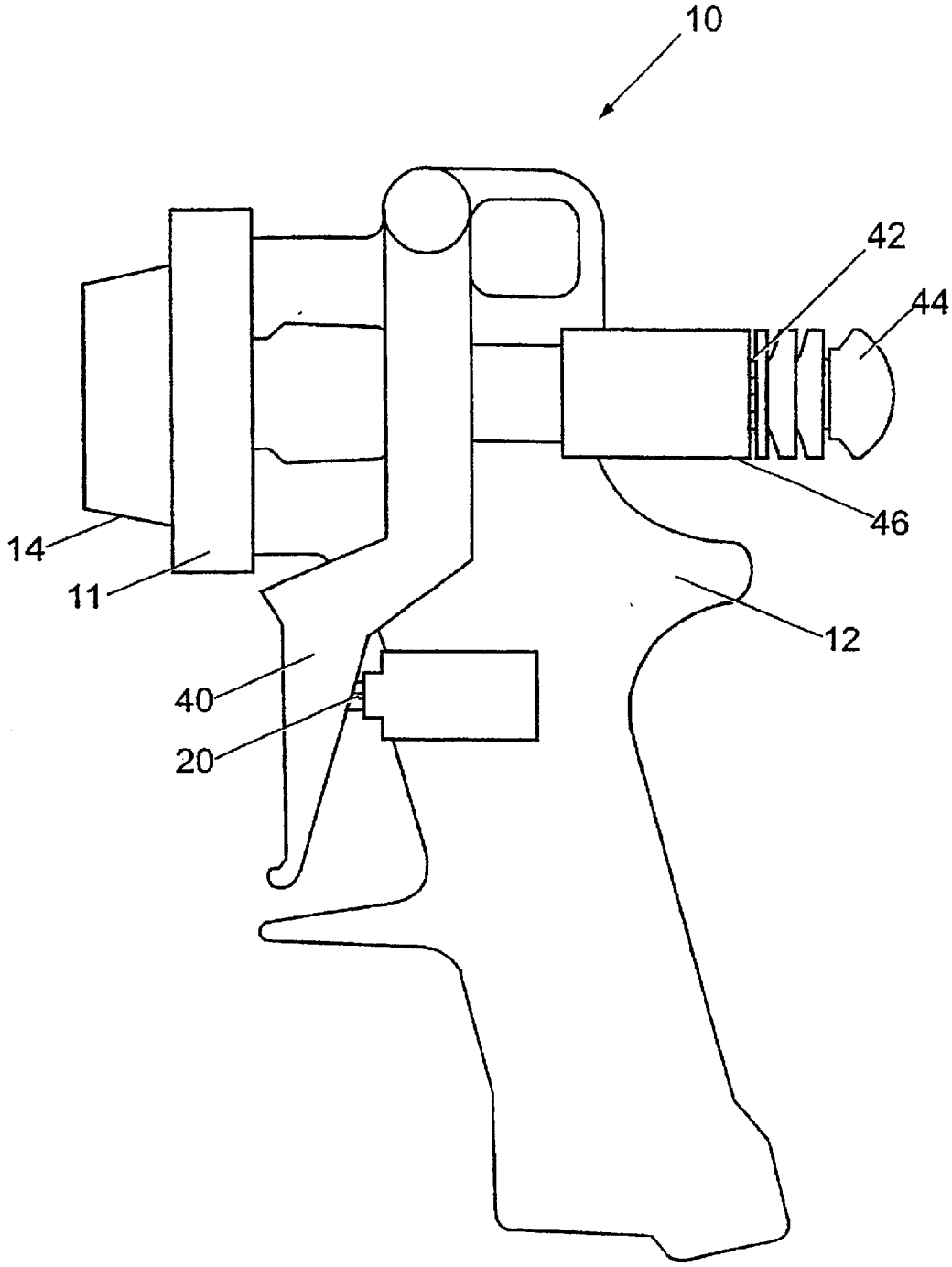
FIG. 3 shows a second embodiment of a spray gun according to the present invention.

FIG. 3 shows a second embodiment of a spray gun apparatus 10 according to the present invention. Externally, the second embodiment appears similar to the apparatus of the first embodiment. However, the sectional views of FIGS. 4(*a*)–(*c*) highlight the difference between the two embodiments.

Figure 4A:
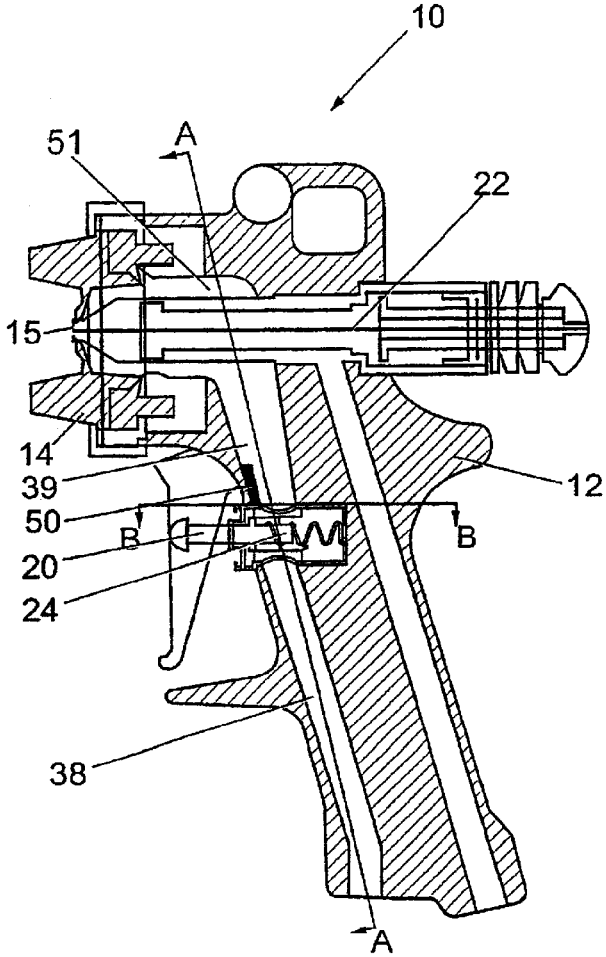
FIG. 4(*a*) shows a section through the spray gun of FIG. 3 having offset air passages and a tapered upper air passage.
Figure 4B:
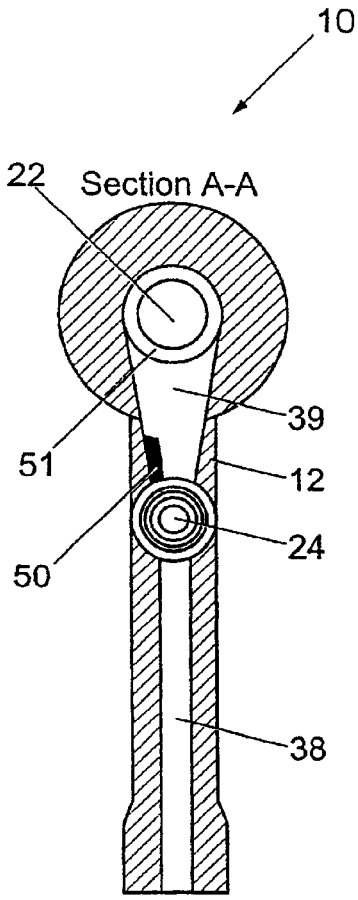
Figure 4C:
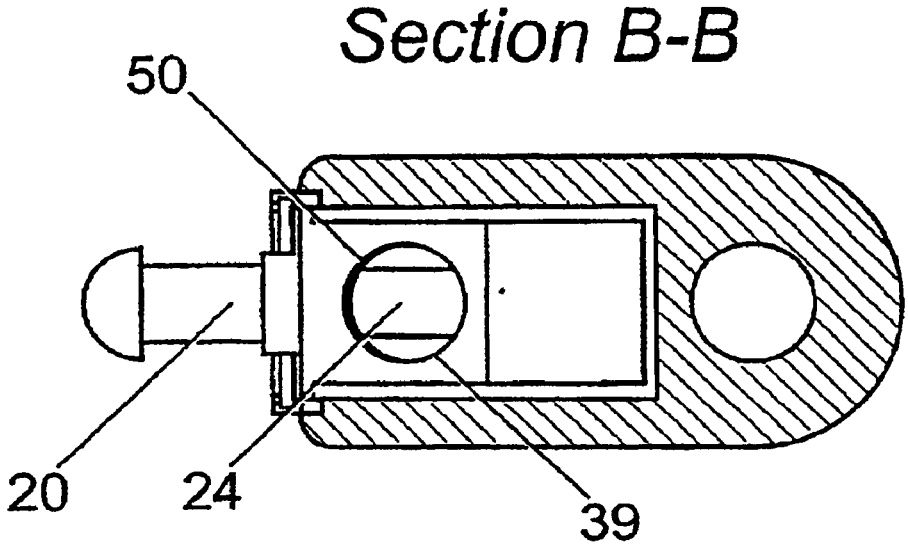

FIGS. 4(*a*)–(*c*) show views of the second embodiment of the spray gun 10 in which upper air passage 39 has been modified to assist the creation of the vortex within the upper passage 39. FIG. 4(*b*) shows the tapering of the upper passage 39 to assist the acceleration of the gas therein. The best acceleration results have been produced when the tapering is between 0 and 10°. FIG. 4(*c*) shows the cross-section B—B of the upper passage 39 at its inlet, wherein a stepped portion 50 is provided. For the most effective vortex, the stepped portion 50 should encompass approximately 10% of the circumference of the upper passage 39.

The vortex is created in the upper passage 39 as the gas passes through the inlet of upper passage 39 over the stepped portion 50, which can be best seen in FIG. 4(*b*). As the gas passes over the stepped portion 50, the increased area causes the gas to swirl in the passage, thereby creating the vortex which produces a gas acceleration upwards through the upper passage 39. The tapering of the upper passage 39 ensures that the vortex is sustained until it reaches the outlet of the upper passage 39 at nozzle 14.

As with each of the embodiments described herein, the liquid control valve needle 22 passes through the uppermost chamber 51 of the upper passage 39. This is best seen in FIG. 4(*b*), where the valve 22 passes directly through the chamber 51 in such a way as to not hinder the vortex created in the upper passage 39.

Thus, the vortex flows through the chamber 51 relatively unhindered by the valve 22 as the gas flows around the outside of the valve 22, and the vortex is not destroyed by the valve 22.

Aside from the amendments to the passage 39, this embodiment of the spray gun 10 is constructed and operated substantially in the same manner as the spray gun 10 of FIG. 1.

Figure 5:
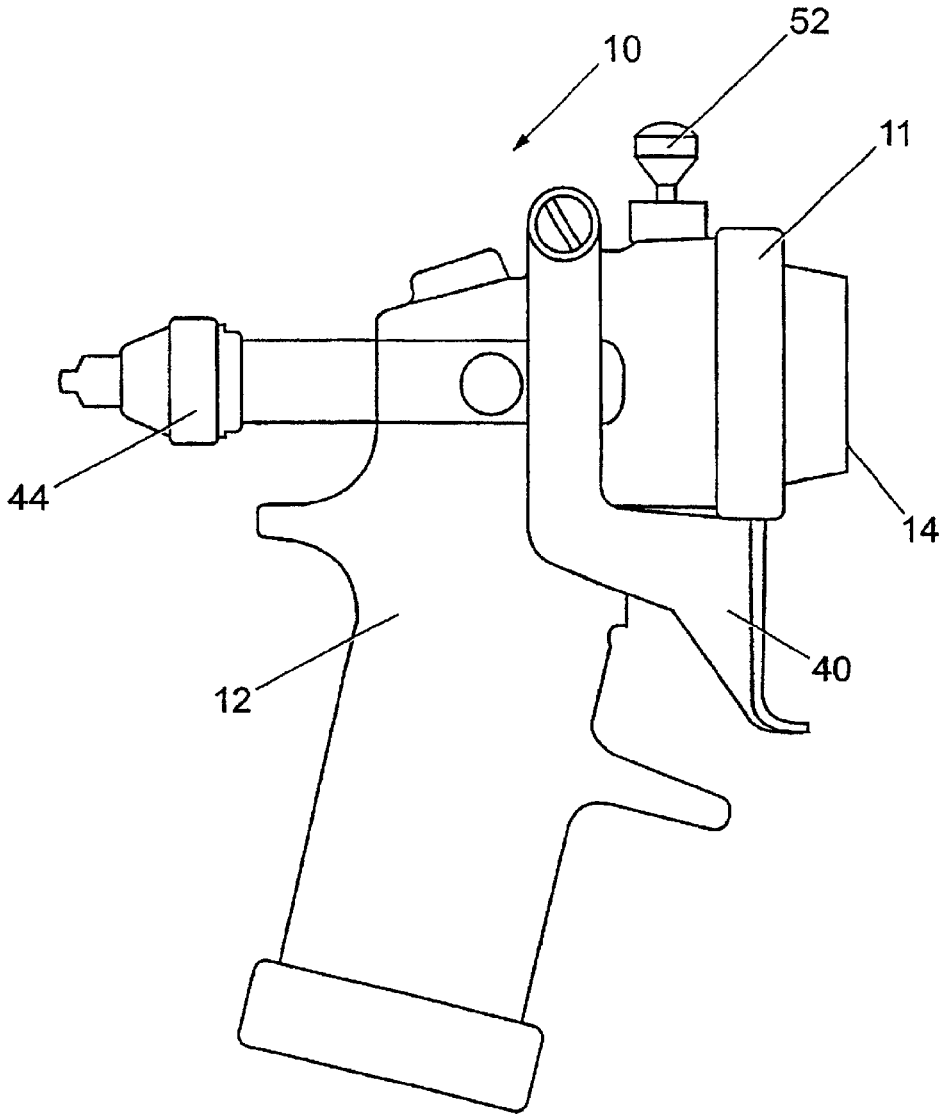
FIG. 5 shows a third embodiment of a spray gun according to the present invention.
Figure 6A:
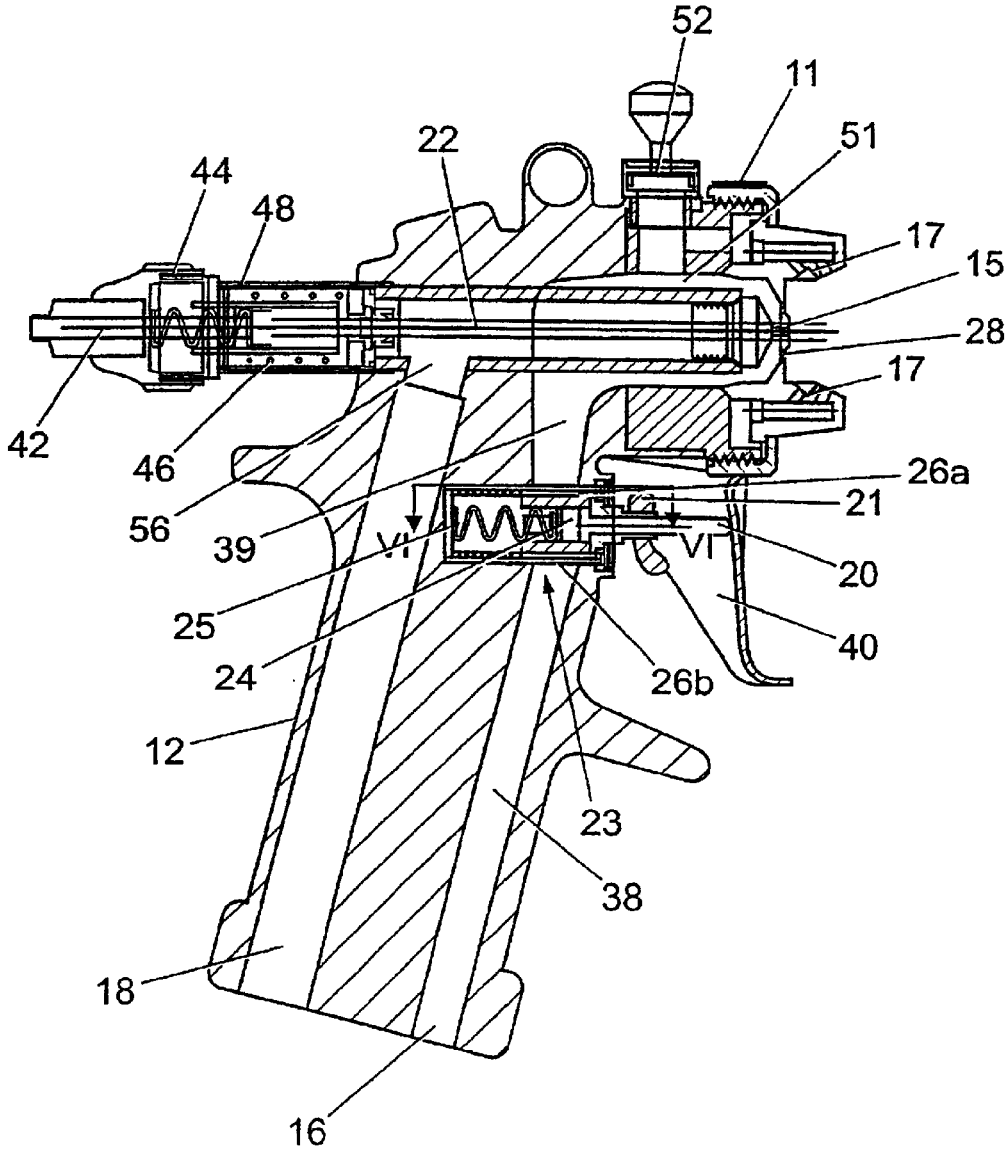
FIG. 6(*a*) shows a section through the spray gun of FIG. 5.
Figure 6B:
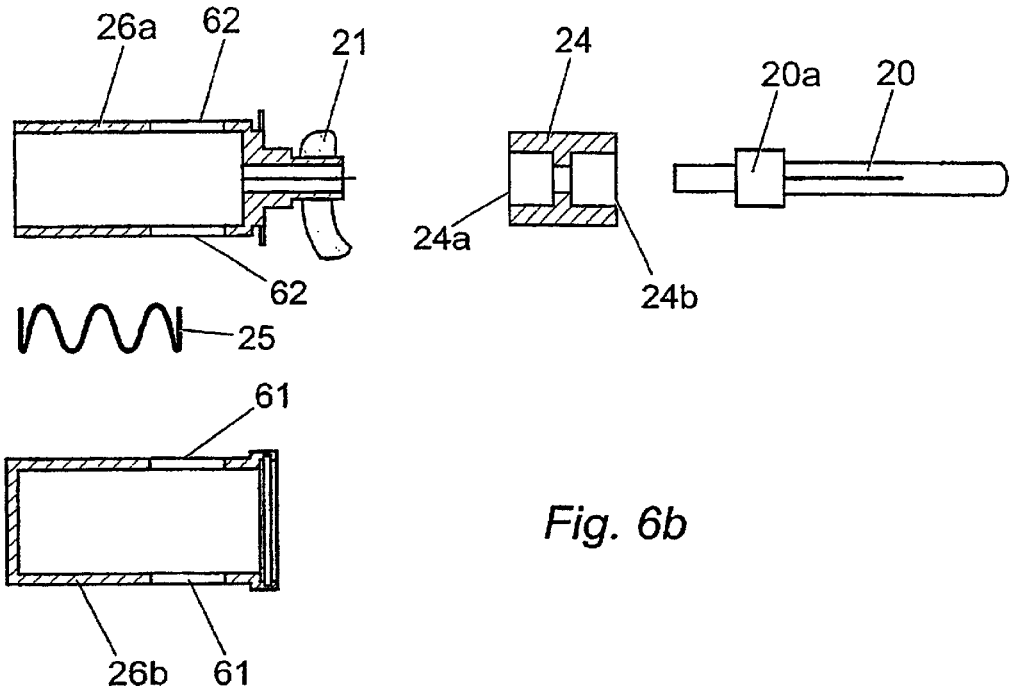
Figure 6C:
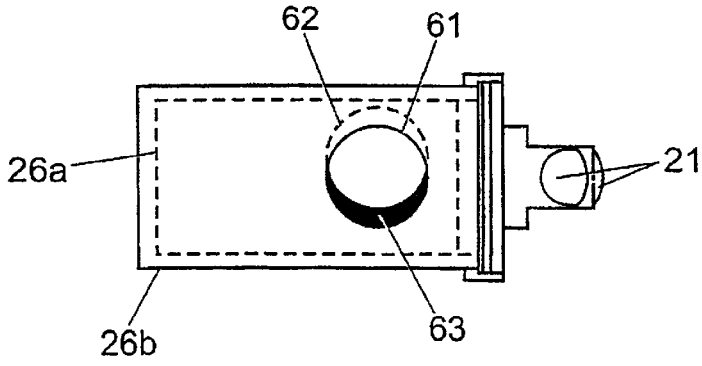

The third and final of the preferred embodiments described is shown in FIGS. 5 and 6(*a*)–(*c*). Again, externally, the spray gun 10 is similar in appearance to the other embodiments, with the majority of the components previously described above being used. However, the third embodiment differs in the operation of the piston valve assembly 23 which produces the vortex.

The use of a pair of apertured sleeves 26*a*, 26*b* within the piston valve assembly 23 was first discussed in the description of the first embodiment above. However, the individual components of the piston valve assembly 23 are best seen in FIG. 6(*b*). The valve assembly 23 consists of an apertured outer sleeve 26*b* and an apertured inner sleeve 26*a*, and each of the sleeves 26*a*, 26*b* has a pair of apertures 61, 62. On each sleeve 26*a*, 26*b*, the apertures 61, 62 are located diametrically opposite one another, thereby permitting gas to pass through the sleeves 26*a*, 26*b* unhindered.

FIG. 6(*a*) shows the manner in which the various components of the valve assembly 23 co-operate. The inner sleeve 26*a* is located inside the outer sleeve 26*b*, with the apertures 61,62 of the two sleeves 26*a*, 26*b* being axially aligned to allow gas to pass directly through the sleeves 26*a*, 26*b*. The inner sleeve 26*a* is fitted with a lever 21 so that the inner sleeve 26*a* may be rotated relative to the outer sleeve 26*b*. A return spring 25 is located within the sleeves 26*a*, 26*b* with a piston 24 positioned thereon. The piston 24 receives the spring 25 on one end 24*a* and an air control valve stem 20 on the other end 24*b*. The stem 20 has a flange 20*a* which locates in the second end 24*b* of the piston so that the stem 20 may act on the piston 24.

Thus, in order to operate the piston valve assembly 23, the trigger 40 is pulled towards the housing 12 of the apparatus 10. As the trigger 40 is pulled, it acts on the valve stem 20 which in turn acts on the piston 24. The action of the trigger 40 thus pushes the piston 24 away from the air passages, thereby permitting the gas to pass through the valve assembly 23 by way of the aligned apertures 61, 62 in the inner and outer sleeves 26*a*, 26*b*. When the trigger 40 is released, the spring 25 pushes the piston 24, stem 20, and trigger 40 back to their original positions, and gas can therefore no longer pass through the valve assembly 23.

FIG. 6(*c*) shows how the alignment of the apertures 61, 62 on the inner and outer sleeves 26*a*, 26*b* can be varied to improve the vortex generation in the upper air passage 39. The lever 21 can be rotatably adjusted in order to rotate the inner sleeve 26*a* relative to the fixed outer sleeve 26*a*. Thus, as is seen in FIG. 6(*c*), the apertures 61,62 can be offset from each other. This offsetting of the apertures 61,62 creates a lip portion 63, where a portion of the inner sleeve 26*a* partly blocks the aperture 61 of the outer sleeve 26*a*. Thus, the gas flowing through the valve assembly 23 is disrupted thereby creating the vortex in the upper passage 39 of the apparatus 10.

In use, each of the embodiments is operated as follows: The reservoir of material to be sprayed delivers the material to central jet is under the control of needle valve 22 where it is mixed with air delivered via air passages 38 and 39. The operation of the gun is initiated by trigger 40 operating air control valve stem 20 and liquid control valve 22.

The present invention provides a method and apparatus for spraying that addresses the limitations and inefficiencies of prior spray guns. As it may operate at pressures as low as 1.5 psi in the air cap and at air volumes as low as 4 cfm, energy savings are achieved. The very low pressures allow a very high transfer efficiency to be achieved which is an added advantage when used with paints containing volatile organic compounds.

The present invention permits the trigger 40 to operate the air control valve 23 and the fluid control valve 22 simultaneously, without restricting the operation of either, regardless of the adjustment of the other. The stems of both the fluid control needle valve 22 and air control piston valve 23 operate in parallel to each other, yet independently of each other.

The above permits a straight, unobstructed, large diameter air passage 38 to the air valve 23 while also permitting a short, straight air passage 39 to the air cap 52 and a large diameter fluid passage.

In addition, by offsetting the air passages 38,39, gas acceleration may be achieved by means of a vortex created by the gas passing through these passages 38,39. With gas acceleration in the head portion of the apparatus 10, the increased speed of the gas created by the vortex leads to an increase in air speed at the nozzle 14 and thereby an increase in material sprayed by the gun. Therefore, although gas is introduced to the apparatus 10 from a compressor at relatively low pressure, by having the air passages 38,39 arranged in the offset position a gas acceleration is achieved with a consequential increase in efficiency at the nozzle 14. Moreover, the gas acceleration is further improved by the provision of a pair of adjustable, apertured sleeves 26*a*, 26*b* which can either increase or decrease gas flow into the vortex from the air valve 23 depending on the alignment of the apertures 61,62.

The features of the present invention:

i) reduce the compressed air volume required;

ii) reduce the pressure of said compressed air;

iii) reduce energy losses;

iv) improve exit air speed;

v) increase depression at the fluid nozzle; and vi) reduce resistance to fluid flow.

The internal surface area of the air passages is approximately 50% less than a representative selection of spray guns currently available.

The trigger to air cap air passage length is 75% less than with the representative selection.

Total air passage length is approximately 40% less than with the representative selection.

Input air pressure is 75% lower than the average of the representative selection.

Air volume required is approximately 50% lower than the average of the representative selection.

Depression at the fluid nozzle is approximately 30% greater than the representative selection.

These and other improvements and modifications can be incorporated without departing from the scope of the invention.

What is claimed is:

1. An apparatus for spraying liquid surface treatment material, said apparatus comprising:

a housing;

a liquid inlet for supply of the liquid surface treatment material;

a gas inlet for supply of pressurised gas to be mixed with the liquid surface treatment material;

an outlet nozzle through which the gas and liquid surface treatment material is sprayed;

a control valve adapted to regulate the supply of the liquid surface treatment material to the outlet nozzle;

a gas valve operable between an open position and a closed position;

a first communicating passageway connecting said gas inlet to said gas valve;

a second communicating passageway connecting said gas valve to said outlet nozzle;

wherein said second passageway is provided with a stepped portion therein so that a gas vortex is created therethrough, and wherein said second passageway includes an inlet and an outlet, said second passageway being tapered from said inlet to said outlet between 1 to 15°.

2. An apparatus for spraying liquid surface treatment materials, said apparatus comprising:

a housing;

a liquid inlet for supply of the liquid surface treatment material;

a gas inlet for supply of pressurised gas to be mixed with the liquid surface treatment material;

an outlet nozzle *rough which the gas and liquid surface treatment material is sprayed;

a control valve adapted to regulate the supply of the liquid surface treatment material to the outlet nozzle;

a gas valve operable between an open position and a closed position;

a fist communicating passageway connecting said gas inlet to said gas valve;

a second communicating passageway connecting said gas valve to said outlet nozzle;

wherein said second passageway is provided with a stepped portion therein so that a gas vortex is created therethrough, and wherein said second passageway includes an inlet and an outlet, wherein said second passageway is tapered from said inlet to said outlet and has a radius of curvature at said outlet so as to provide gas to the outlet nozzle in a substantially horizontal direction.

3. An apparatus for spraying liquid surface treatment material, said apparatus comprising:

a housing;

a liquid inlet for supply of the liquid surface treatment material;

a gas inlet for supply of pressurised gas to be mixed with the liquid surface treatment material;

an outlet nozzle through which the gas and liquid surface treatment material is sprayed;

a control valve adapted to regulate the supply of the liquid surface treatment material to the outlet nozzle;

a gas valve operable between an open position and a closed position;

a first communicating passageway connecting said gas inlet to said gas valve;

a second communicating passageway connecting said gas valve to said outlet nozzle;

wherein said second passageway is provided with a step portion therein so that a gas vortex is created therethrough, said stepped portion of said second passageway comprising a ledge whose width tapers up to a maximum of 10% of the radius of said second passageway at the level of the stepped portion.

4. An apparatus according to claim 3, wherein the longitudinal axis of said outlet nozzle extends across said second passageway.

5. An a according to claim 4, wherein the axis of symmetry of said ledge is offset from said longitudinal axis of said outlet nozzle.

6. An apparatus for spraying liquid surge treatment material, said apparatus comprising:

a housing;

a liquid inlet for supply of the liquid surface treatment material;

a gas inlet for supply of pressurised gas to be mixed with the liquid surface treatment material;

an outlet nozzle through which the gas and liquid surface treatment material is sprayed;

a control valve adapted to regulate the supply of the liquid surface treatment material to the outlet nozzle;

a gas valve operable between an open position and a closed position;

a first communicating passageway connecting said gas inlet to said gas valve; and a second communicating passageway connecting said gas valve to said outlet nozzle;

wherein said second passageway is axially offset from said first passageway and is substantially conical in shape, and wherein said second passageway includes an inlet and an outlet and outwardly tapers from said inlet to said outlet at an angle of taper of between 1 and 15°.

7. An apparatus according to claim 6, further comprising a trigger means;

whereby said trigger means is adapted to operate both of said control valve and said gas valve.

8. An apparatus according to claim 7, wherein said control valve is a liquid control needle valve.

9. An apparatus according to claim 8, wherein said gas valve is an axially-sliding piston valve.

10. An apparatus according to claim 9, wherein said outlet nozzle is controlled by said liquid control needle valve.

11. An apparatus according to claim 9, wherein said piston valve produces an annular air jet in said second passageway.

12. An apparatus according to claim 9, further comprising an air control valve stem which is connected to said piston valve and operated by said trigger means.

13. An apparatus according to claim 9, wherein said piston valve comprises an inner sleeve and an outer apertured sleeve, said inner and outer sleeves being co-axial, and wherein said inner sleeve is located within said outer sleeve and is rotatably adjustable relative to said outer sleeve.

14. An apparatus according to claim 8, wherein the liquid control needle valve is controlled by said trigger means via an axially-sliding sleeve or slipper member situated on a rearward portion of said housing.

15. An apparat according to claim 8, wherein said liquid control needle valve is provided with a rotational flow adjustment means.

16. An apparatus according to claim 15, wherein said flow adjustment means comprises a stem member, a rotational adjuster, and a return spring, said stem member being threaded at its rearmost extremity to accept said rotational adjuster.

17. An apparatus according to claim 16, whiten said stem member is actuated externally by said trigger means, and is returned to its initial position by said return spring.

18. An apparatus according to claim 8, wherein said liquid inlet comprises a pressurized material supply connector, and wherein said needle valve is supplied with a liquid by said pressurized material supply connector.

19. An apparatus according to claim 8, wherein said liquid inlet comprises a gravity feed liquid reservoir, and wherein said needle valve is supplied with a liquid by said gravity liquid reservoir.

20. An apparatus according to claim 6, further comprising a regulating valve and a pair of side jets, whereby the spray pattern of the outlet nozzle is regulated by said regulating valve, and said side jets are utilised to regulate said spray pattern.

21. A method of spraying a liquid onto a surface, said method comprising the steps of:

supplying a liquid to be sprayed into a liquid inlet of a spray apparatus;

supplying a pressurised gaseous propellant into a gas inlet of said spray apparatus;

passing said gaseous propellant through a communicating passageway from said gas inlet to an outlet nozzle;

accelerating said gaseous propellant by crating a gas vortex as said propellant passes through said communicating passageway;

passing said accelerated propellant through an outwardly tapering portion of the communicating passageway to further accelerate the vortex and supply the propellant to the outlet nozzle in the form of an annular gas jet, the portion tapering outwardly in the direction of propellant flow; and spraying said liquid onto a surface by mixing said liquid and said annular gas jet at said nozzle.

22. A method according to claim 21, wherein said passageway comprises an upper portion and a lower portion, wherein said upper potion is axially offset from said lower portion and is substantially conical in shape.

23. A method according to claim 22, wherein said upper portion of said passageway includes an inlet and an outlet and is tapered from said inlet to said outlet at an angle of taper of between 1 and 15°.

24. A method according to claim 21, wherein the mixing of said liquid and said annular gas jet is controlled by a trigger valve mechanism on said spray apparatus.

25. A method according to claim 24, wherein said trigger valve mechanism comprises:

a gas valve operable between an open position and a closed position;

a control valve adapted to regulate the supply of the liquid to be sprayed; and a trigger means;

whereby said trigger means is adapted to operate both of said gas and control valves.

26. A method according to claim 25, wherein said control valve is a liquid control needle valve.

27. A method according to claim 26, wherein said gas valve is an axially-sliding piston valve.

28. A method according to claim 27, wherein said piston valve comprises an inner apertured sleeve and an outer apertured sleeve, said inner and outer sleeves being co-axial, and wherein said inner sleeve is located within said outer sleeve and is rotatably adjustable relative to said outer sleeve.

* * * * *